US012221239B2

(12) United States Patent
Farley et al.

(10) Patent No.: US 12,221,239 B2
(45) Date of Patent: Feb. 11, 2025

(54) METHODS AND SYSTEMS OF USING POCKET ROLLER TO PLACE OBJECTS ON MOVING WEB

(71) Applicant: 3M INNOVATIVE PROPERTIES COMPANY, St. Paul, MN (US)

(72) Inventors: Joseph B. Farley, New Brighton, MN (US); Ronald P. Swanson, Woodbury, MN (US); Matthew R. D. Smith, Woodbury, MN (US); Matthew S. Stay, Bloomington, MN (US); Shawn C. Dodds, St. Paul, MN (US); Kara A. Meyers, Oakdale, MN (US); Kayla C. Niccum, Maplewood, MN (US); Mikhail L. Pekurovsky, Bloomington, MN (US); Lyudmila A. Pekurovsky, Bloomington, MN (US); Saagar A. Shah, Minneapolis, MN (US)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 0 days.

(21) Appl. No.: 18/711,210

(22) PCT Filed: Nov. 29, 2022

(86) PCT No.: PCT/IB2022/061536
§ 371 (c)(1),
(2) Date: May 17, 2024

(87) PCT Pub. No.: WO2023/100074
PCT Pub. Date: Jun. 8, 2023

(65) Prior Publication Data

US 2025/0011020 A1 Jan. 9, 2025

Related U.S. Application Data

(60) Provisional application No. 63/264,789, filed on Dec. 2, 2021.

(51) Int. Cl.
*B65B 15/04* (2006.01)
*B65H 37/00* (2006.01)

(52) U.S. Cl.
CPC ..... *B65B 15/04* (2013.01); *B65H 37/002* (2013.01); *B65H 2701/12* (2013.01)

(58) Field of Classification Search
CPC .... B65B 15/04; B65H 37/002; B65H 2701/12
See application file for complete search history.

(56) References Cited

U.S. PATENT DOCUMENTS

RE36,329 E 10/1999 Laroche
7,820,481 B2 10/2010 Cote et al.
(Continued)

FOREIGN PATENT DOCUMENTS

EP 3712077 A1 9/2020
JP 2017024756 A 2/2017
WO 1993020973 A1 10/1993

OTHER PUBLICATIONS

International Search Report for PCT International Application No. PCT/IB2022/061536, mailed on Mar. 1, 2023, 6 pages.

*Primary Examiner* — Daniel McNally
(74) *Attorney, Agent, or Firm* — Thomas M. Spielbauer

(57) ABSTRACT

Methods and systems of using pocket roller (110, 130) to place objects on a continuously moving web (2) are provided. The objects are received in an array of pockets (124) on a major surface of a roller sleeve (120). The roller sleeve (120) engages with an adhesive surface (22) of the continuously moving web (2) to place the objects on the web (2).

15 Claims, 6 Drawing Sheets

(56) References Cited

U.S. PATENT DOCUMENTS

| | | | | |
|---|---|---|---|---|
| 2003/0079446 | A1 | 5/2003 | Behnke | |
| 2004/0079055 | A1 | 4/2004 | Lehner et al. | |
| 2008/0066853 | A1* | 3/2008 | Schiebout | B65B 15/04 156/519 |
| 2019/0263546 | A1 | 8/2019 | Vissers | |

* cited by examiner

METHODS AND SYSTEMS OF USING POCKET ROLLER TO PLACE OBJECTS ON MOVING WEB

CROSS REFERENCE TO RELATED APPLICATIONS

This application is a national stage filing under 35 U.S.C. 371 of PCT/IB2022/061536, filed 29 Nov. 2022, which claims the benefit of U.S. Application No. 63/264,789, filed 2 Dec. 2021, the disclosure of which is incorporated by reference in its/their entirety herein.

BACKGROUND

Flexible or flex circuits are widely used by assembling rigid electronic circuits or chips with flexible substrates such as polymetric webs. Flexible electronic assemblies may be manufactured using similar rigid components used for rigid printed circuit boards, allowing the assemblies to conform to a desired shape, or to flex during its use. Current literature and practice for applying rigid chips onto a flexible web in a roll to roll setting is overwhelmingly done by stepping and stopping the entire web before placing the chips on the web, then starting web movement again and repeating ad infinitum.

SUMMARY

There is a desire to assemble rigid electronic chips with flexible substrates in a simple and cost-effective way. Briefly, in one aspect, the disclosure describes a method of placing objects on a moving web. The method includes positioning a roller adjacent to the web. The roller includes a roller sleeve mounted thereon, and the roller sleeve comprises the array of pockets on a major surface thereof. The method further includes continuously moving the web along a machine direction at a predetermined speed, and without substantially changing the predetermined speed of the web, engaging the roller sleeve with an adhesive surface of the web, and separating the moving web from the roller sleeve such that the plurality of rigid objects is attached to the adhesive surface of the web.

In another aspect, this disclosure describes a roll-to-roll system of placing rigid objects on a moving web. The system includes a roller including a roller sleeve. The roller sleeve includes an array of pockets on a major surface thereof. The pockets of the roller sleeve are configured to receive the rigid objects. A moving web includes an adhesive surface to be engaged with the roller sleeve.

Various unexpected results and advantages are obtained in exemplary embodiments of the disclosure. One such advantage of exemplary embodiments of the present disclosure is the ability to continuously run a web while placing objects thereon without having to stop the web. Furthermore, the construction of the present disclosure also allows for the placement object to function in a printing process for registration purposes.

Various aspects and advantages of exemplary embodiments of the disclosure have been summarized. The above Summary is not intended to describe each illustrated embodiment or every implementation of the present certain exemplary embodiments of the present disclosure. The Drawings and the Detailed Description that follow more particularly exemplify certain preferred embodiments using the principles disclosed herein.

BRIEF DESCRIPTION OF THE DRAWINGS

The disclosure may be more completely understood in consideration of the following detailed description of various embodiments of the disclosure in connection with the accompanying drawings, in which.

Figure 1A:
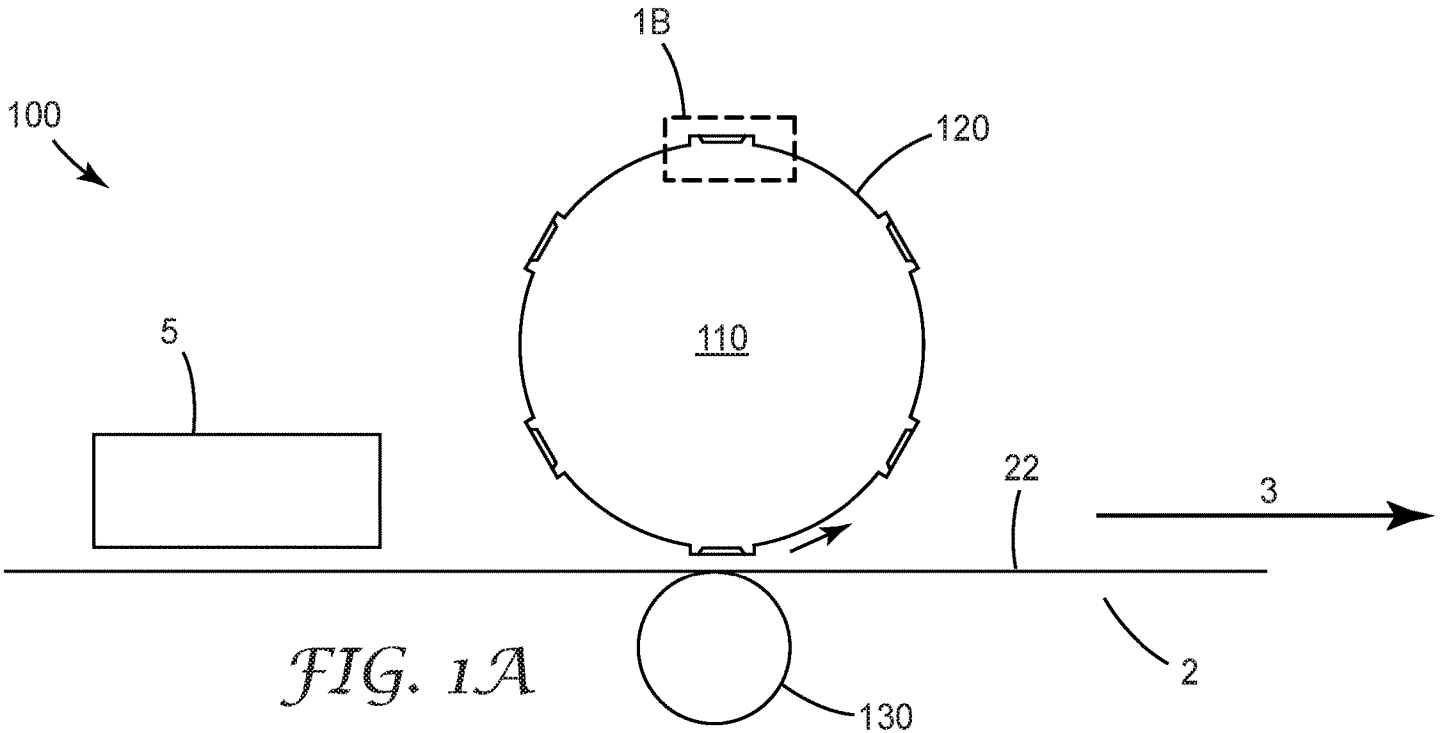
FIG. 1A is a schematic diagram of a system to place rigid chips onto a moving web, according to one embodiment of this disclosure.

In the drawings, like reference numerals indicate like elements. While the above-identified drawings, which may not be drawn to scale, sets forth various embodiments of the present disclosure, other embodiments are also contemplated, as noted in the Detailed Description. In all cases, this disclosure describes the presently disclosed disclosure by way of representation of exemplary embodiments and not by express limitations. It should be understood that numerous other modifications and embodiments can be devised by those skilled in the art, which fall within the scope and spirit of this disclosure.

DETAILED DESCRIPTION

For the following Glossary of defined terms, these definitions shall be applied for the entire application, unless a different definition is provided in the claims or elsewhere in the specification.

Glossary

Certain terms are used throughout the description and the claims that, while for the most part are well known, may require some explanation. It should be understood that:

In this application, the term "roll-to-roll process" or "roll-to-roll system" refers to methods or systems of manufacture that embeds, coats, prints, laminates or imparts other transformative work on a flexible, rolled substrate material or materials as they are fed continuously from one roller to another.

The term "roller sleeve" refers to a shell of material, to be placed over an existing roller, containing features upon its surface with which to perform a function upon a web different to the roller it is placed over.

In this application, by using terms of orientation such as "atop", "on", "over," "covering", "uppermost", "underlying" and the like for the location of various elements in the disclosed coated articles, we refer to the relative position of an element with respect to a horizontally-disposed, upwardly-facing substrate (e.g., web). However, unless otherwise indicated, it is not intended that the substrate (e.g., web) or articles should have any particular orientation in space during or after manufacture.

In this application, by using the term "overcoated" to describe the position of a layer with respect to a substrate (e.g., web) or other element of an article of the present disclosure, we refer to the layer as being atop the substrate (e.g., web) or other element, but not necessarily contiguous to either the substrate (e.g., web) or the other element.

In this application, the term "machine direction" refers to the direction in which the substrate or web travels. Similarly, the term "cross-web direction" refers to the direction perpendicular to the machine direction (i.e., substantially perpendicular to the direction of travel for the web), and in the plane of the top surface of the web.

In this application, the terms "about" or "approximately" with reference to a numerical value or a shape means +/− five percent of the numerical value or property or characteristic, but expressly includes the exact numerical value. For example, a viscosity of "about" 1 Pa-sec refers to a viscosity from 0.95 to 1.05 Pa-sec, but also expressly includes a viscosity of exactly 1 Pa-sec. Similarly, a perimeter that is "substantially square" is intended to describe a geometric shape having four lateral edges in which each lateral edge has a length which is from 95% to 105% of the length of any other lateral edge, but which also includes a geometric shape in which each lateral edge has exactly the same length.

In this application, the term "substantially" with reference to a property or characteristic means that the property or characteristic is exhibited to a greater extent than the opposite of that property or characteristic is exhibited. For example, a substrate (e.g., web) that is "substantially" transparent refers to a substrate (e.g., web) that transmits more radiation (e.g. visible light) than it fails to transmit (e.g. absorbs and reflects). Thus, a substrate (e.g., web) that transmits more than 50% of the visible light incident upon its surface is substantially transparent, but a substrate (e.g., web) that transmits 50% or less of the visible light incident upon its surface is not substantially transparent.

In this application, the singular forms "a", "an", and "the" include plural referents unless the content clearly dictates otherwise. Thus, for example, reference to fine fibers containing "a compound" includes a mixture of two or more compounds. As used in this specification and the appended embodiments, the term "or" is generally employed in its sense including "and/or" unless the content clearly dictates otherwise.

As used in this application, the recitation of numerical ranges by endpoints includes all numbers subsumed within that range (e.g., 1 to 5 includes 1, 1.5, 2, 2.75, 3, 3.8, 4, and 5).

Various exemplary embodiments of the disclosure will now be described with particular reference to the Drawings. Referring to FIG. 1A, a schematic diagram of a continuous chip-placement system 100 is provided for a roll-to-roll process, according to one embodiment. The system 100 includes a roller 110 with a roller sleeve or shell 120 mounted on the outer surface of the roller 110. In some embodiments, the roller 110 can be an air-loadable plate roller. The roller 110 may contain an air bearing, created by adding pressurized air to a port in its side.

The roller sleeve 120 includes an array of pockets 124 on a major surface 122 thereof. The pockets 124 of the roller sleeve 120 are configured to receive rigid objects such as, for example, electronic/semiconductor chips or circuits. A pocket may include multiple straight or curved walls. In some embodiments, a pocket may also contain a manufactured draft in each wall of up to thirty degrees to improve ease of chip placement in the pocket itself. Geometries of the pockets can vary drastically by application. The pocket length and width may be limited by the curvature of the roller sleeve.

Figure 1B:
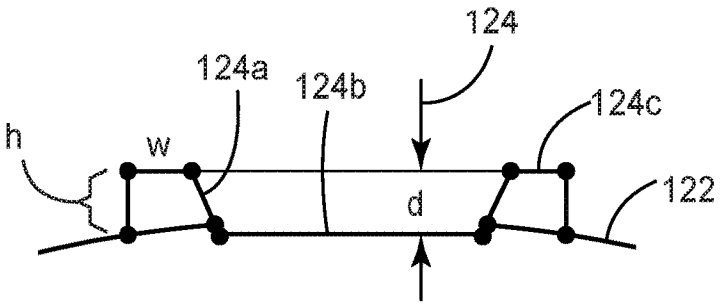
FIG. 1B is a schematic view of a pocket of FIG. 1A.

FIG. 1B illustrates an exemplary pocket 124. The pocket 124 includes a side wall 124*a* and a bottom surface 124*b* surrounded by the side wall 124*a*. In the embodiment depicted in FIG. 1B, the side wall 124*a* projects from the major surface 122 of the roller sleeve 120 with a height h. The pocket 124 has a depth d as measured as the vertical distance between the upper edge 124*c* of the side wall 124*a* and the bottom surface 124*b*. The pocket depth d can be in the range, for example, from 0.1 mm to 20 mm, from 0.2 mm to 10 mm, or from 0.254 mm to 6.35 mm. The height h may be, for example, about 10% to about 100% of the depth d. The side wall 124*a* has a thickness w in the range, for example, from 10 micrometers to 10 mm, from 20 micrometers to 5 mm, or from 27 micrometers to 3 mm. The side wall 124*a* may be thin or flexible enough to allow the rigid chip to fit in by friction. In the depicted embodiment, the side wall 124*a* has a sloped inner surface and the side wall 124*a* tapers away from the major surface 122 of the roller sleeve 120.

In some embodiments, the roller sleeve 120 may include a deformable layer mounted onto a rigid core (e.g., a metal core, a fiberglass core, a fiberglass shell mounted on a metal core, etc.). The roller sleeve may include one or more materials of an elastomer, a metal, a fabric, or a nonwoven. It is to be understood that the sleeve can be made of any suitable material having the desired flexibility and hardness. In some embodiments, the roller sleeve 120 can be a substantially incompressible elastomer having a hardness, for example, greater than about 40 Shore A, or optionally greater than about 50 Shore A. The thickness of the roller sleeve can be in the range, for example, from 2 mm to 20 cm or from 6.35 mm to 12.7 cm. Suitable elastomers may include thermoset elastomers such as, for example, Nitriles, fluoroelastomers, chloroprenes, epichlorohydrins, silicones, urethanes, polyacrylates, EPDM (ethylene propylene diene monomer) rubbers, SBR (styrene-butadiene rubber), butyl rubbers, nylon, polystyrene, polyethylene, polypropylene, polyester, polyurethane, etc.

In some embodiments, the roller sleeve 120 can be made of an elastomer such as, for example, rubber. The pocket 124 can be formed on the major surface 122 of the roller sleeve 120 by, for example, a rotary laser engraving process. In some embodiments, the sleeve may be a laser-engraved, typically elastomeric construction but may be comprised as other materials such as, e.g., steel or plastic. Features on the sleeve 120 can be made via, for example, rotary laser engraving where a predefined cylinder of elastomer is taken and engraved down until a desired feature height is made for each feature along the surface of the soon-to-be elastomer sleeve. Features on the elastomer sleeve may include, but are not limited to, pockets, registration tabs, placement targets and printing tabs. In many embodiments, features can be engraved with either vertical walls or walls at an angle, or draft, in the laser process. The dimensions of these features and of the sleeve itself may vary depending on the desired applications. The pattern of features on the roller sleeve has a design that can be engraved over the surface area of the roll sleeve. It is thusly designed based on the roller radius of the roller it will be mounted on, along with the overall depth of the pockets.

The pocket 124 can have any desired shapes and sizes to receive a rigid object. The rigid objects are held in the pockets primarily by a friction force. In other words, one or more edges of the rigid object may engage with the side wall 124 of the pocket via a friction force, which is strong enough to hold the rigid chip in the pocket. The rigid chip may have a thickness t which is comparable to the depth d of the pocket. The chip thickness t may be in the range, for example, from 0.5 mm to 10 mm. When the rigid chip is received by the docket, the outer surface of the rigid chip may project above the upper edge 124*c* of the pocket 124.

Referring again to FIG. 1A, a web 2 is moved along a web path at a predetermined speed in the machine direction 3. The web 2 has an adhesive surface 22 facing to the roller 110. A nipping roller 130 is positioned adjacent to the roller 110 to form a nip therebetween. The web 2 enters the nip with the adhesive surface 22 in contact with the roller 110. The roller 110 rotates at a speed matching the moving speed of the web 2 and engages with the moving web 2 to transfer the chips from the pockets 124 to the adhesive surface 22.

In some embodiments, the web 2 may at least partially wrap around the roller 110 or the nipping roller 130. The substrate 2 can be delivered to wrap the roller 110/130 with a wrap angle in the range, for example, from about 0 to about 30 degrees, about 30 degrees to about 90 degrees, or about 90 degrees to about 150 degrees. In some embodiments, a nipping roller is optional. The web 2 may at least partially wrap around the roller 110 to engage with the chips received by the roller sleeve.

The web 2 can include any suitable flexible substrate, such as, for example, a polymer web, a paper, a polymer-coated paper, a release liner, an adhesive coated web, a metal coated web, a flexible glass or ceramic web, a nonwoven, a fabric, or any combinations thereof.

When the web 2 continues moves without substantially changing its predetermined speed, the roller sleeve 120 engages with the adhesive surface 22 of the web 2 such that the outer surface of the rigid chip contacts with the adhesive surface 22 of the web 2. The adhesive bonding between the outer surface of the rigid chip contacts with the adhesive surface 22 is stronger than the friction force between the chip and the pocket. When the moving web separates from the roller sleeve, the rigid objects are attached to the adhesive surface 22 of the web 2 and transferred from the roller sleeve 120 to the web 2. The adhesive has a suitable adhesive property. In other words, the adhesive is sticky enough to adhere to any sort of solid object to be mounted upon it, and the adhesive may not be too sticky to substantially adhere to the engraved roller sleeve. In some embodiments, a double-sided, silicone transfer adhesive can be utilized. Silicone transfer adhesives are suitable because of their ability to bond with many typical materials, e.g., for chips.

The process of placing the rigid objects on the web can be run in tandem with other web processes such as, for example, coating. In the embodiment depicted in FIG. 1A, a coating station 5 is positioned upstream of the roller 110. The coating station 5 can provide one or more coatings on the surface of the web 2 when the web 2 continuously moves along the machine direction. The continuous process of placing the rigid objects on the web allows other processes such as the coating process to run in tandem without stopping the web or substantially changing the movement speed of the web.

Figure 2A:
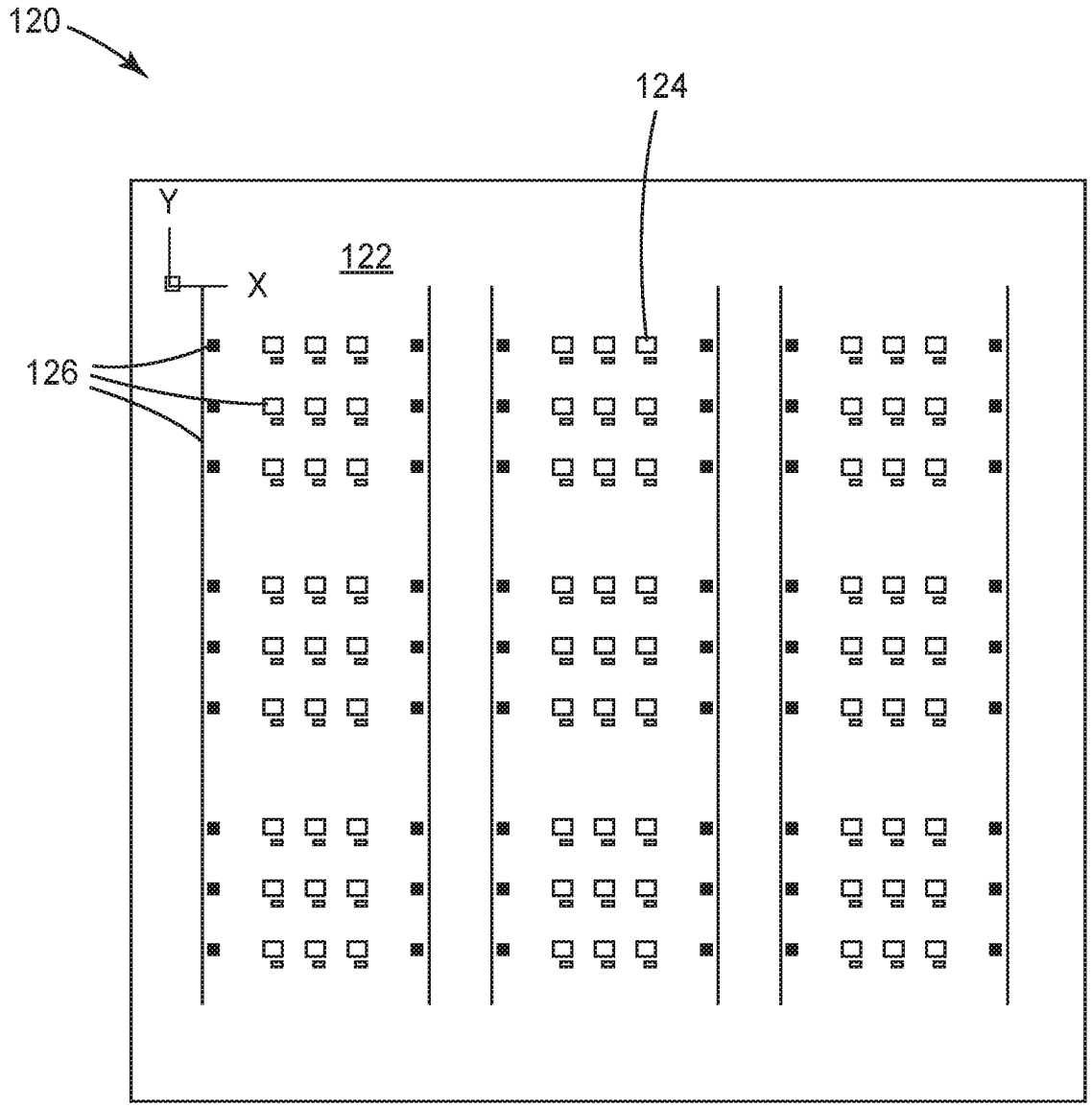
FIG. 2A is a schematic top view of a pattern on a pocket roller sleeve, according to one embodiment of this disclosure.
Figure 2B:
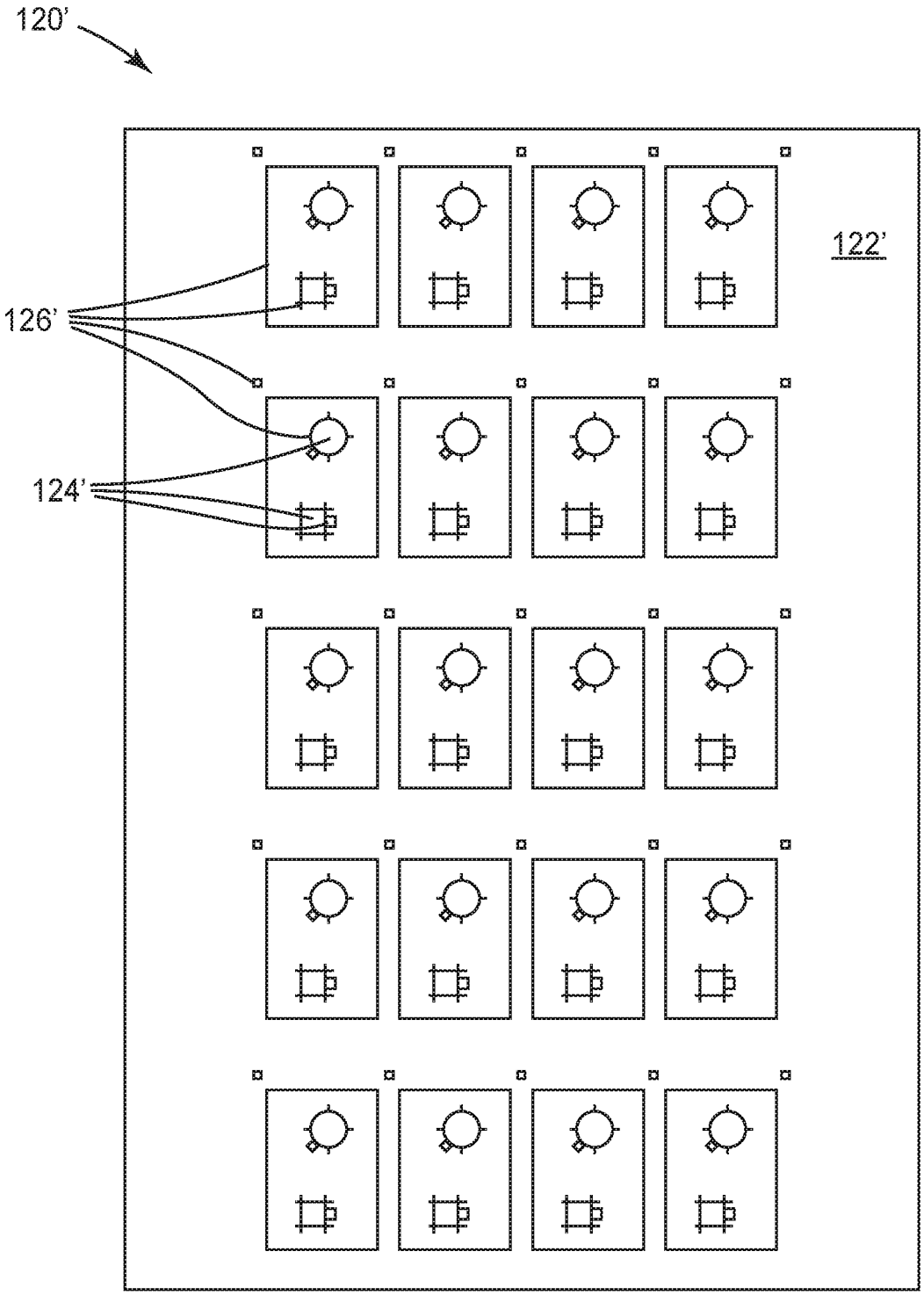
FIG. 2B is a schematic top view of a pattern on a pocket roller sleeve, according to another embodiment of this disclosure.

FIGS. 2A and 2B are schematic top views of exemplary roller sleeves 120, 120' according to some embodiments. As shown in FIG. 2A, the roller sleeve 120 includes an array of pockets 124 on the major surface 122 thereof. The pockets 124 are arranged by rows and columns along the cross-web direction (i.e., the x axis) and the machine direction (i.e., the y axis). Registration marks 126 are also provided on the major surface 122 of the roller sleeve 120 along with the array of pockets 124. The registration marks 126 can be any desired shapes or sizes, and are used to facilitate roller position correction and to check placement fidelity.

Exemplary registration marks may include walls provided on the major surface 122 of the roller sleeve 120. In the depicted embodiment of FIG. 2B, the registration marks 126 include walls extending along the y axis. Exemplary registration marks may also include various patterns or shapes to be printed onto the web, including, for example, an outline of a circuit or chip, multiple right angles, quarter crosses, which may be used as registration marks for chips to be placed. It is to be understood that the web 2 may include one or more fiducials as registration marks of a registration system to facilitate correction of errors caused by tension, adhesive pulling, or other such problems that would cause the chips to fall outside of their marked placement points on the web 2.

In some embodiments, due to the semi-rigid nature of the sleeve, the pattern of features on the sleeve may double as a registration printing device as well as a rigid object carrier. With these features, the embodiments allow to both print rolls of part registration marks as well as place rigid bodies via an adhesive on a web. The registration marks can be used to control the speed of the sleeve in rotation, such as to offload the step and repeat motion in part placement from a web. By letting the web stay as a continuously moving entity, a multitude of web processes that would otherwise be unavailable to a step and repeat process can be run in series or tandem with rigid part placement.

As shown in FIG. 2B, the roller sleeve 120' includes an array of pockets 124' on the major surface 122' of the roller sleeve 120'. Registration marks 126' are also provided on the major surface 122. In the depicted embodiment of FIG. 2B, there are three pockets designated by 124' in this instance, though other designs could have many more or many less. The pockets indicate the locations where the solid parts will be placed on the web.

Figure 3A:
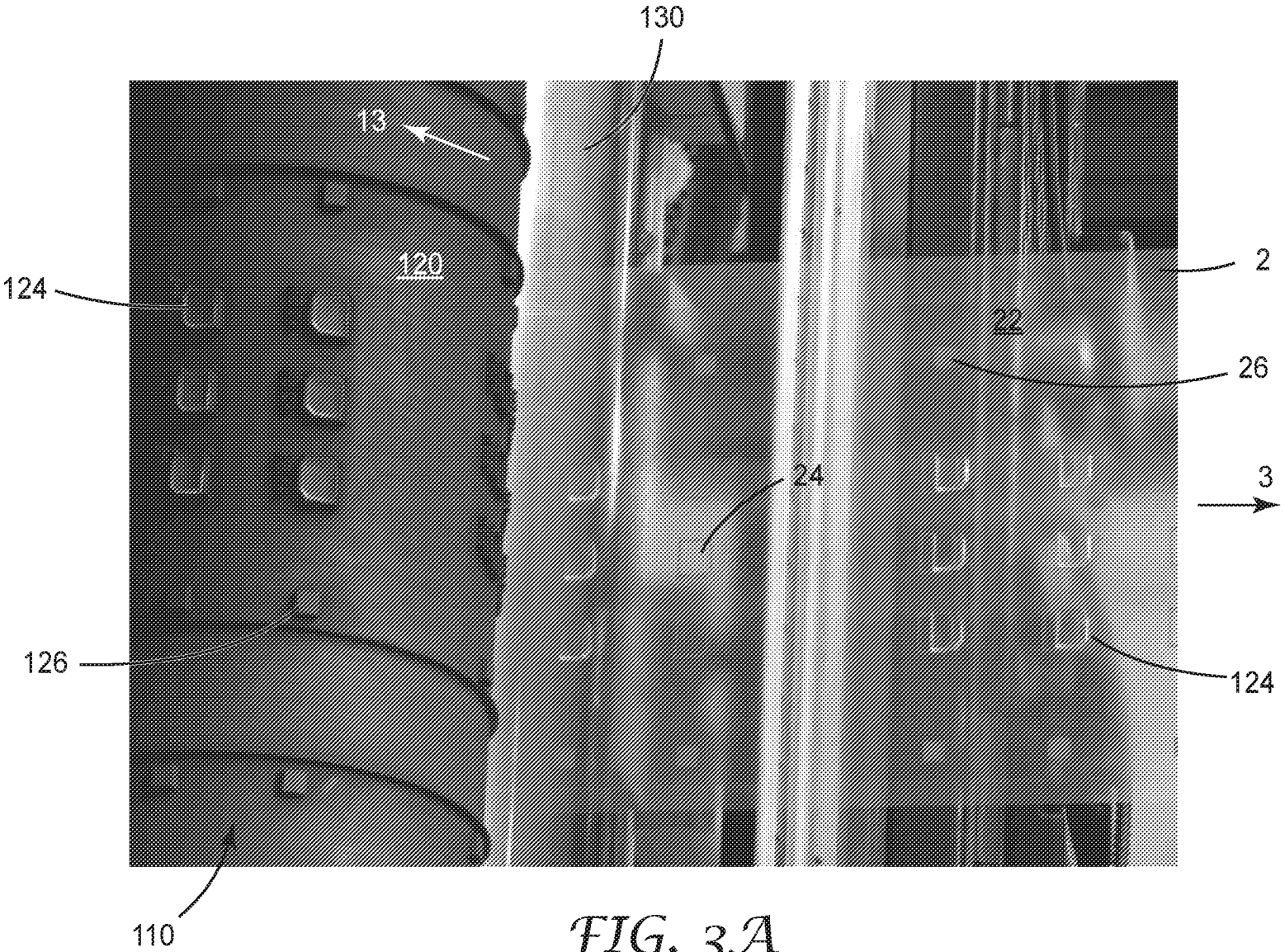
FIG. 3A is a side perspective view of a roll-to-roll system to place rigid chips onto a moving web, according to one embodiment of this disclosure.

FIG. 3A is a side perspective view of a roll-to-roll system to place rigid chips onto a moving web, according to one embodiment of this disclosure. The roller 10 nips against another roller 130 and is positioned with its rotation axis substantially parallel to the cross direction of the web 2. Rigid chips 124 are received by the pockets 124 on the major surface 122 of the roller sleeve 120 which is mounted on the roller 110. The rigid chips 124 can be fed into the pockets 124 by any suitable means. In some embodiments, the rigid chips 124 can be serviced by a chip shooter. The chips can be received in the pockets 124 row by row along the axis direction of the roller 110.

The roller 110 rotates at a predetermined speed to match the line speed of the web 2. In some embodiments, the rotation speed of the roller 110 can be adjusted during the operation for loading the chips and for matching the line speed of the moving web. For example, the roller's rotation may be stopped to feed the chips into the pockets, then resumes or increases its speed to bring it back in step with the continuously moving line. In other words, instead of having a web step and repeat, the processes described herein have a single part, the sleeve, perform the step and repeat action of placing parts on a moving web.

Figure 3B:
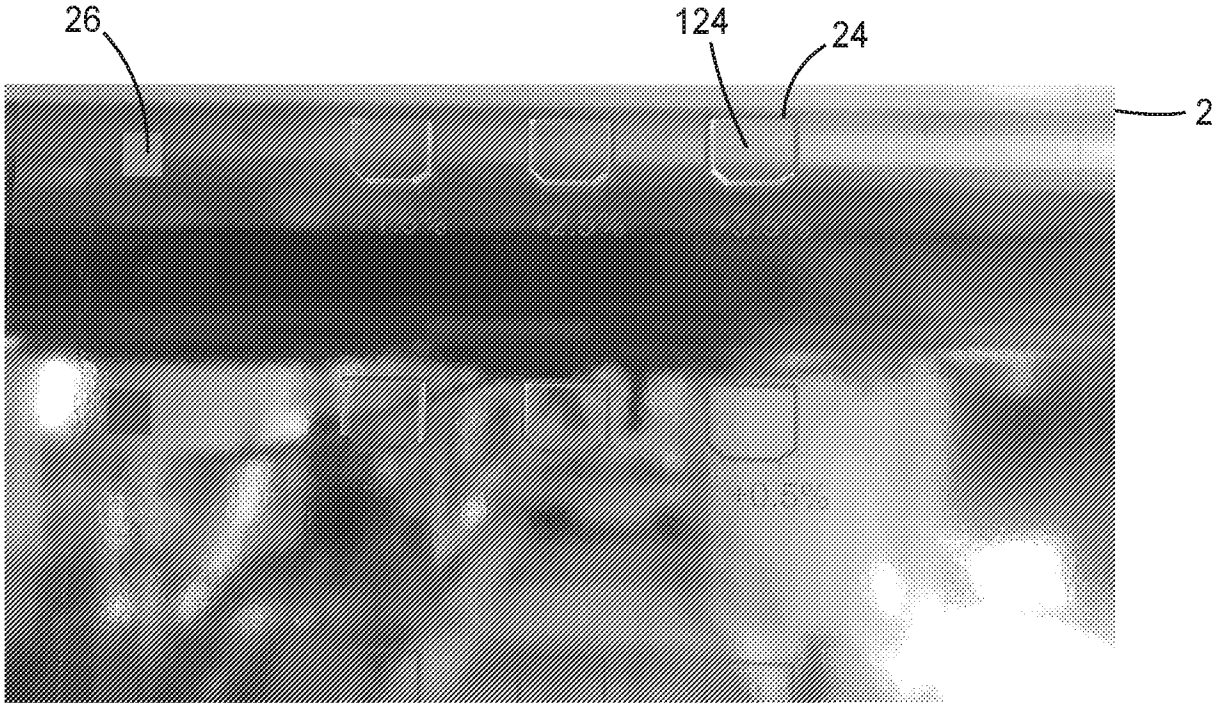
FIG. 3B is a schematic top view of the web of FIG. 3A.

FIG. 3B is a schematic top view of the web 2 of FIG. 3A. The web 2 includes an array of fiducials 22 as registration marks to be aligned with the registration marks 126 of the roller sleeve 120. It is to be understood that any suitable registration system can be used to facilitate the alignment between the chips 124 and their marked placement points 24 on the web 2.

Unless otherwise indicated, all numbers expressing quantities or ingredients, measurement of properties and so forth used in the specification and embodiments are to be understood as being modified in all instances by the term "about." Accordingly, unless indicated to the contrary, the numerical parameters set forth in the specification and more particularly the Listing of Exemplary Embodiments and the claims can vary depending upon the desired properties sought to be obtained by those skilled in the art utilizing the teachings of the present disclosure. At the very least, and not as an attempt to limit the application of the doctrine of equivalents to the scope of the claimed embodiments, each numerical parameter should at least be construed in light of the number of reported significant digits and by applying ordinary rounding techniques.

Exemplary embodiments of the present disclosure may take on various modifications and alterations without departing from the spirit and scope of the present disclosure. Accordingly, it is to be understood that the embodiments of the present disclosure are not to be limited to the following described exemplary embodiments, but are to be controlled by the limitations set forth in the claims and any equivalents thereof.

LISTING OF EXEMPLARY EMBODIMENTS

Exemplary embodiments are listed below. It is to be understood that any one of the embodiments 1-8 and 9-15 can be combined.

Embodiment 1 is a method of placing a plurality of rigid objects on a web, the method comprising:
- positioning a roller adjacent to the web, wherein the roller comprises a roller sleeve mounted thereon, and the roller sleeve comprises an array of pockets on a major surface thereof;
- continuously moving the web along a machine direction at a predetermined speed; and
- without substantially changing the predetermined speed of the web:
  - engaging the roller sleeve with an adhesive surface of the web; and
  - separating the moving web from the roller sleeve such that the plurality of rigid objects is attached to the adhesive surface of the web.

Embodiment 2 is the method of embodiment 1, wherein the rigid objects are held in the pockets primarily by a friction force.

Embodiment 3 is the method of embodiment 1 or 2, further comprising nipping a nipping roller against the roller.

Embodiment 4 is the method of any one of embodiments 1-3, further comprising registering the roller sleeve with respect to the web when the web is moving.

Embodiment 5 is the method of any one of embodiments 1-4, further comprising feeding the rigid objects into the array of pockets.

Embodiment 6 is the method of any one of embodiments 1-5, further comprising adjusting a rotating speed of the roller when feeding the rigid objects into the pockets of the roller sleeve.

Embodiment 7 is the method of any one of embodiments 1-6, further comprising adjusting the rotating speed of the roller to match the predetermined speed of the moving web.

Embodiment 8 is the method of any one of embodiments 1-7, further comprising engraving into a major surface of the roller sleeve to form the pockets.

Embodiment 9 is a roll-to-roll system of placing objects on a moving web, the system comprising:
- a roller comprising a roller sleeve, the roller sleeve comprising an array of pockets on a major surface thereof, the pockets of the roller sleeve being configured to receive the objects; and
- a moving web comprising an adhesive surface to be engaged with the roller sleeve.

Embodiment 10 is the system of embodiment 9, wherein the objects are held in the pockets primarily by a friction force.

Embodiment 11 is the system of embodiment 9 or 10, further comprising a nipping roller to nip with the roller.

Embodiment 12 is the system of any one of embodiments 9-11, wherein the roller sleeve further comprises one or more registration marks on the major surface thereof to register the roller sleeve with respect to the moving web.

Embodiment 13 is the system of any one of embodiments 9-12, further comprising a feeding device to feed the objects into the array of pockets.

Embodiment 14 is the system of any one of embodiments 9-13, wherein the roller sleeve is a rubber sleeve.

Embodiment 15 is the system of any one of embodiments 9-14, wherein the objects comprise semiconductor chips.

The operation of the present disclosure will be further described with regard to the following detailed examples. These examples are offered to further illustrate the various specific and preferred embodiments and techniques. It should be understood, however, that many variations and modifications may be made while remaining within the scope of the present disclosure.

EXAMPLES

These Examples are merely for illustrative purposes and are not meant to be overly limiting on the scope of the appended claims. Notwithstanding that the numerical ranges and parameters setting forth the broad scope of the present disclosure are approximations, the numerical values set forth in the specific examples are reported as precisely as possible. Any numerical value, however, inherently contains certain errors necessarily resulting from the standard deviation found in their respective testing measurements. At the very least, and not as an attempt to limit the application of the doctrine of equivalents to the scope of the claims, each numerical parameter should at least be construed in light of the number of reported significant digits and by applying ordinary rounding techniques.

A rubber-sleeve was prepared where pockets were laser engraved into the outer surface of the sleeve along with registration marks. A pattern of the pockets and the registration marks is shown in FIG. 3A. The pockets each have a dimension of 11.25 mm long×9 mm wide×2.54 mm deep. The rubber-sleeve was mounted on an air-loadable mandrel plate roller. Chips were manually placed in the pockets which were nipped against an adhesive surface of a web. The adhesive surface pulled the chips out from the pockets. The chips were attached on the web marked with inked targets and registration marks. A registration system was utilized to facilitate correction of errors caused by tension, adhesive pulling, or other such problems that would cause the chips to fall outside of their marked placement points on the web. In a moving line environment, a continuous operation was conducted by manually feeding the pockets with chips and transferring to a moving web at 5 mm/s to 10 mm/s. The system was controlled via a native programmable logic controller (PLC) coding and numerically control motion via code within Beckhoff PLC, commercially available from Beckhoff Automation, Verl, Germany.

Figure 4:
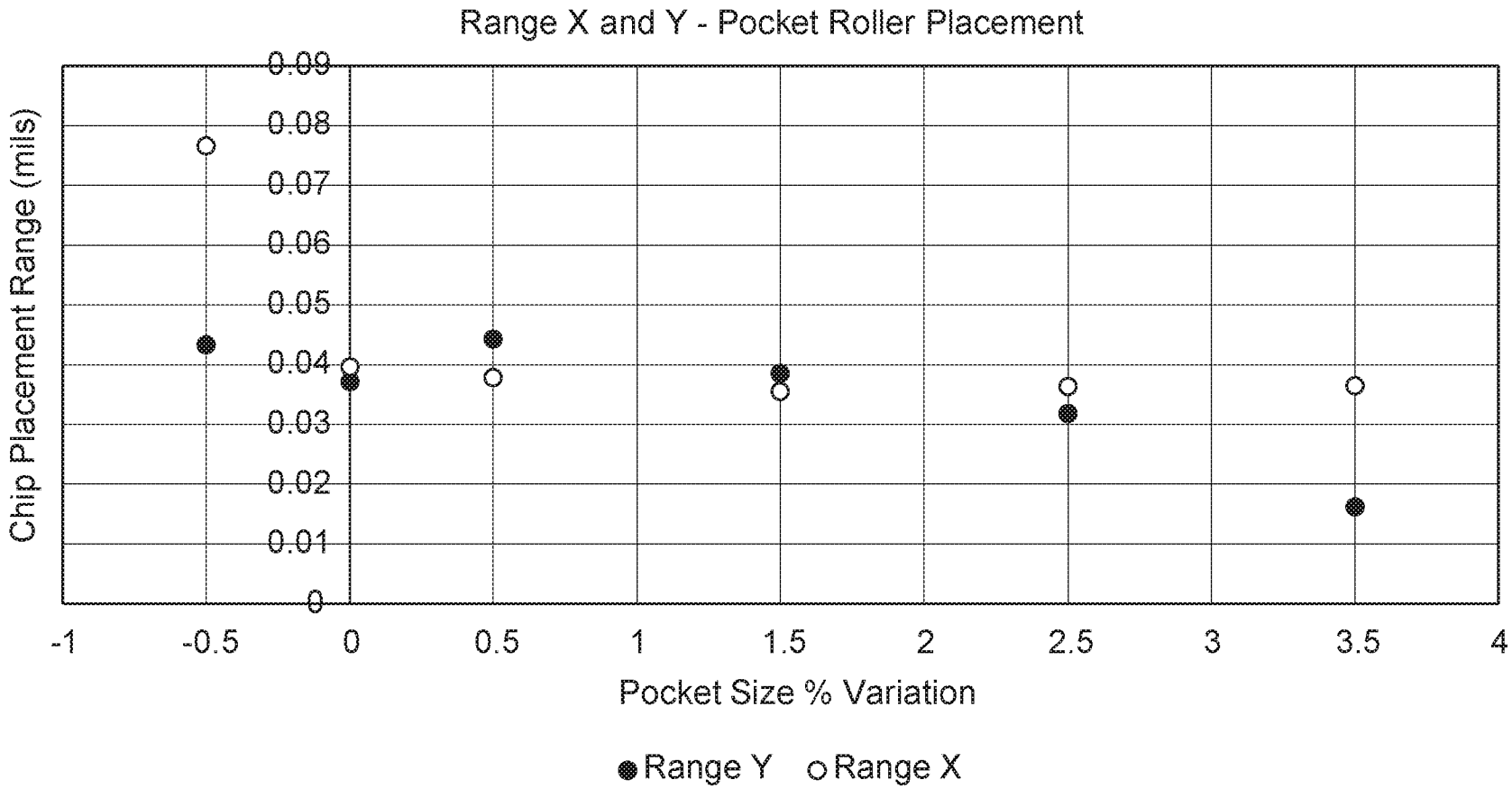
FIG. 4 is a plot of chip placement range versus pocket size variation for examples.

Fidelity of the chip placement was checked and shown to be substantially within the tens of mils (1 mil=0.0254 mm) range in either direction (i.e., the cross-web direction x and the machine direction y). FIG. 4 is a plot of chip placement range versus pocket size variation for various examples. The pocket sizes along the x or y axis are varied from the original of 11 mm×9 mm from −0.5% to +2.5%, which provides a tighter fit (negative values) or a looser fit (positive values). What was desired by changing these dimensions was a sort of tolerancing of the pockets to the parts placed. It was observed that a tighter fit, towards −0.5% change in total pocket cross-section area, results in an undesired increase part placement variability along the x axis, or the cross-web direction. When placing parts, it was observed that a correlation of a looser fit may result in a better down-web placement, while not affecting the cross-web placement in a notable manner outside of reducing the pocket size to a point where the parts would not fit.

Reference throughout this specification to "one embodiment," "certain embodiments," "one or more embodiments" or "an embodiment," whether or not including the term "exemplary" preceding the term "embodiment," means that a particular feature, structure, material, or characteristic described in connection with the embodiment is included in at least one embodiment of the certain exemplary embodiments of the present disclosure. Thus, the appearances of the phrases such as "in one or more embodiments," "in certain embodiments," "in one embodiment" or "in an embodiment" in various places throughout this specification are not necessarily referring to the same embodiment of the certain exemplary embodiments of the present disclosure. Furthermore, the particular features, structures, materials, or characteristics may be combined in any suitable manner in one or more embodiments.

While the specification has described in detail certain exemplary embodiments, it will be appreciated that those skilled in the art, upon attaining an understanding of the foregoing, may readily conceive of alterations to, variations of, and equivalents to these embodiments. Accordingly, it should be understood that this disclosure is not to be unduly limited to the illustrative embodiments set forth hereinabove. In particular, as used herein, the recitation of numerical ranges by endpoints is intended to include all numbers subsumed within that range (e.g., 1 to 5 includes 1, 1.5, 2, 2.75, 3, 3.80, 4, and 5). In addition, all numbers used herein are assumed to be modified by the term "about."

Furthermore, all publications and patents referenced herein are incorporated by reference in their entirety to the same extent as if each individual publication or patent was specifically and individually indicated to be incorporated by reference. Various exemplary embodiments have been described. These and other embodiments are within the scope of the following claims.

What is claimed is:

1. A method of placing a plurality of rigid objects on a web, the method comprising:

positioning a roller adjacent to the web, wherein the roller comprises a roller sleeve mounted thereon, and the roller sleeve comprises an array of pockets on a major surface thereof;

continuously moving the web along a machine direction at a predetermined speed; and without substantially changing the predetermined speed of the web:

engaging the roller sleeve with an adhesive surface of the web; and separating the moving web from the roller sleeve such that the plurality of rigid objects is attached to the adhesive surface of the web.

2. The method of claim 1, wherein the rigid objects are held in the pockets primarily by a friction force.

3. The method of claim 1, further comprising nipping a nipping roller against the roller.

4. The method of claim 1, further comprising registering the roller sleeve with respect to the web when the web is moving.

5. The method of claim 1, further comprising feeding the rigid objects into the array of pockets.

6. The method of claim 1, further comprising adjusting a rotating speed of the roller when feeding the rigid objects into the pockets of the roller sleeve.

7. The method of claim 1, further comprising adjusting the rotating speed of the roller to match the predetermined speed of the moving web.

8. The method of claim 1, further comprising engraving into a major surface of the roller sleeve to form the pockets.

9. A roll-to-roll system of placing objects on a moving web, the system comprising:

a roller comprising a roller sleeve, the roller sleeve comprising an array of pockets on a major surface thereof, the pockets of the roller sleeve being configured to receive the objects; and a moving web comprising an adhesive surface to be engaged with the roller sleeve.

10. The system of claim 9, wherein the objects are held in the pockets primarily by a friction force.

11. The system of claim 9, further comprising a nipping roller to nip with the roller.

12. The system of claim 9, wherein the roller sleeve further comprises one or more registration marks on the major surface thereof to register the roller sleeve with respect to the moving web.

13. The system of claim 9, further comprising a feeding device to feed the objects into the array of pockets.

14. The system of claim 9, wherein the roller sleeve is a rubber sleeve.

15. The system of claim 9, wherein the objects comprise semiconductor chips.

* * * * *